US012729849B2

(12) United States Patent
Grzebien et al.

(10) Patent No.: US 12,729,849 B2
(45) Date of Patent: Sep. 8, 2026

(54) NOZZLE TIP FOR A SOLID FUEL BURNER

(71) Applicant: General Electric Technology GMBH, Baden (CH)

(72) Inventors: Kevin Grzebien, Schenectady, NY (US); John Childs Lewis, Schenectady, NY (US); Kenneth Richard Smyth, Schenectady, NY (US)

(73) Assignee: General Electric Technology GMBH, Baden (CH)

( * ) Notice: Subject to any disclaimer, the term of this patent is extended or adjusted under 35 U.S.C. 154(b) by 768 days.

(21) Appl. No.: 18/246,978

(22) PCT Filed: Oct. 1, 2021

(86) PCT No.: PCT/US2021/071678

§ 371 (c)(1),
(2) Date: Mar. 28, 2023

(87) PCT Pub. No.: WO2022/073031

PCT Pub. Date: Apr. 7, 2022

(65) Prior Publication Data

US 2023/0228412 A1 Jul. 20, 2023

Related U.S. Application Data

(60) Provisional application No. 63/086,756, filed on Oct. 2, 2020.

(51) Int. Cl.
*F23D 1/00* (2006.01)

(52) U.S. Cl.
CPC ..... *F23D 1/00* (2013.01); *F23D 2201/101* (2013.01); *F23D 2201/30* (2013.01); *F23D 2212/10* (2013.01); *F23D 2212/20* (2013.01)

(58) Field of Classification Search
CPC .. F23D 1/00; F23D 2201/101; F23D 2201/30; F23D 2212/10; F23D 2212/20; F23D 2201/20; F23D 1/04
See application file for complete search history.

(56) References Cited

U.S. PATENT DOCUMENTS

| | | | | |
|---|---|---|---|---|
| 3,823,875 A * | 7/1974 | Bauer | F23D 1/00 239/590.5 |
| 4,520,739 A * | 6/1985 | McCartney | F23D 1/00 239/587.5 |
| 2011/0146545 A1* | 6/2011 | Morse | F23D 1/00 29/890.054 |

FOREIGN PATENT DOCUMENTS

| | | |
|---|---|---|
| KR | 2012 0001181 A | 1/2012 |
| WO | 84/00314 A1 | 2/1984 |

* cited by examiner

*Primary Examiner* — David J Laux
(74) *Attorney, Agent, or Firm* — Grogan, Tuccillo & Vanderleeden, LLP

(57) ABSTRACT

A nozzle tip for a pulverized solid fuel pipe nozzle of a pulverized solid fuel-fired furnace is provided. The nozzle tip includes an inner nozzle portion and an outer nozzle portion that receives therein the inner nozzle portion. The outer nozzle portion has a lower supporting surface that is configured to support a lower surface of the inner nozzle portion. The outer nozzle portion also includes a plurality of ribs that define therebetween a plurality of flow passages for the passage of air. The ribs, in addition to define the airflow passages, provide bolstering support for the lower supporting surface. The outer nozzle portion is formed from stainless steel.

7 Claims, 6 Drawing Sheets

NOZZLE TIP FOR A SOLID FUEL BURNER

BACKGROUND

Technical Field

Embodiments of the invention relate generally to firing systems for use with pulverized solid fuel burners, and more specifically, to an adjustable nozzle tip for use in such firing systems.

Discussion of Art

Systems for delivering pulverized solid fuel (e.g., coal) to steam generators typically include a plurality of nozzle assemblies through which the pulverized coal is delivered, using air, into a combustion chamber of the steam generator. The nozzle assemblies are typically disposed within windboxes, which may be located proximate to the corners of the steam generator. Each nozzle assembly includes a nozzle tip, which protrudes into the combustion chamber. Each nozzle tip delivers a single stream, or jet, of the pulverized coal and air into the combustion chamber. After leaving the nozzle tip, the single pulverized coal/air jet disperses in the combustion chamber.

Typically, the nozzle tips are arranged to tilt up and down to adjust the location of the flame within the combustion chamber. The flames produced at each pulverized solid fuel nozzle are stabilized through global heat- and mass-transfer processes. Thus, a single rotating flame envelope (e.g., a "fireball"), centrally located in the furnace, provides gradual but thorough and uniform pulverized solid fuel-air mixing throughout the entire furnace.

Although the pulverized solid fuel nozzle tips of the prior art are operative for their intended purposes, there has nevertheless been evidenced in the prior art a need for such pulverized solid fuel nozzle tips to be further improved, specifically in the pursuit of greater durability and service life. In particular, existing nozzle tips are ceramic castings which can be damaged by extremely high temperatures within the combustion chamber and/or by impacts from falling slag.

In view of the above, there is a need for a pulverized coal nozzle tip that is more durable and has a longer service life than existing nozzle tips.

BRIEF DESCRIPTION

In an embodiment, a nozzle tip for a pulverized solid fuel pipe nozzle of a pulverized solid fuel-fired furnace is provided. The nozzle tip includes an inner nozzle portion and an outer nozzle portion that receives therein the inner nozzle portion. The outer nozzle portion has a lower supporting surface that is configured to support a lower surface of the inner nozzle portion. The outer nozzle portion also includes a plurality of ribs that define therebetween a plurality of flow passages for the passage of air. The ribs, in addition to define the airflow passages, provide bolstering support for the lower supporting surface. The outer nozzle portion is formed from stainless steel.

DRAWINGS

The present invention will be better understood from reading the following description of non-limiting embodiments, with reference to the attached drawings, wherein below:

DETAILED DESCRIPTION

Figure 1:
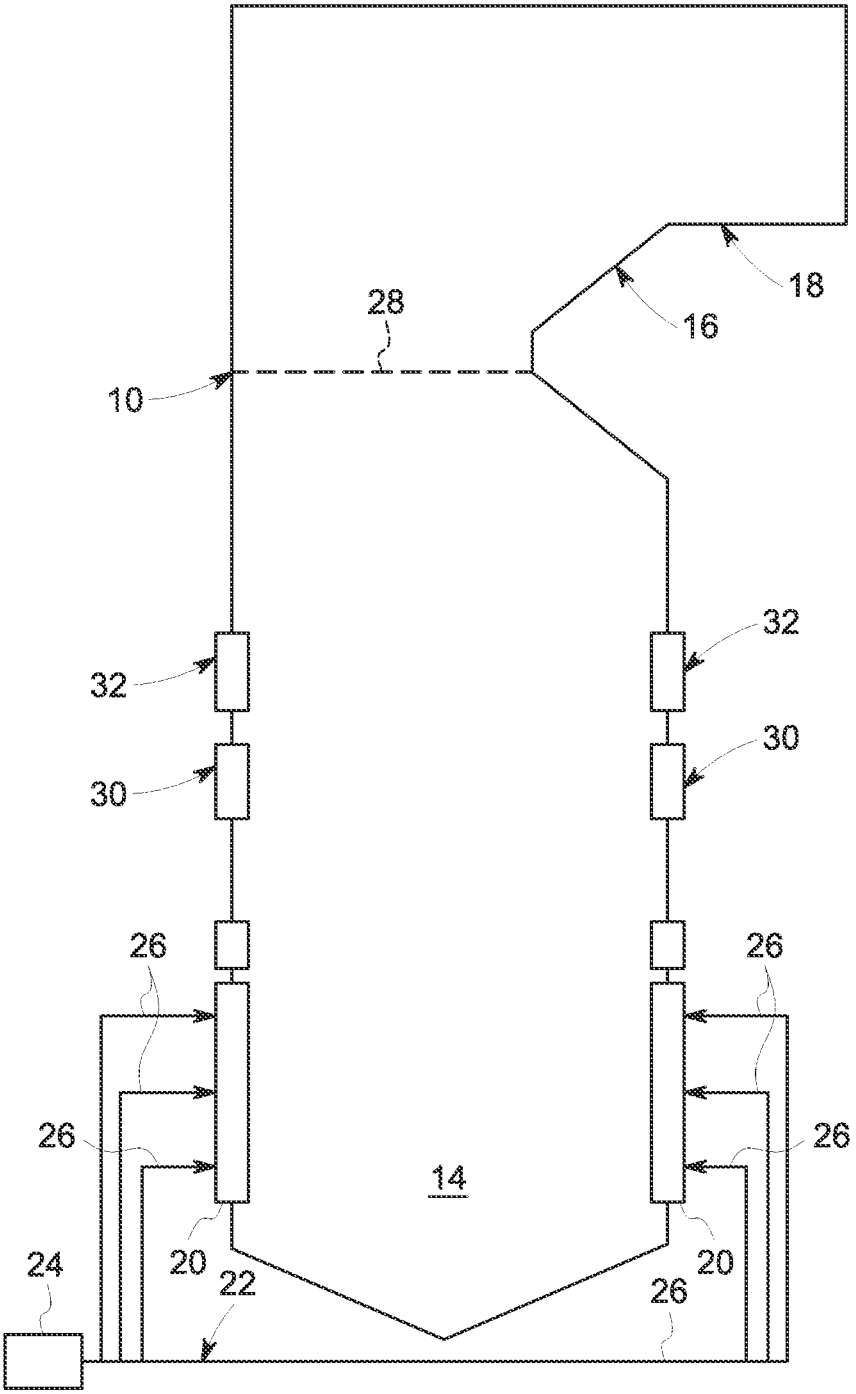
FIG. 1 is a diagrammatic representation of a vertical sectional view of a pulverized solid fuel-fired furnace embodying a firing system with which a solid fuel nozzle tip construction in accordance with the invention may be utilized.

Reference will be made below in detail to exemplary embodiments of the invention, examples of which are illustrated in the accompanying drawings. Wherever possible, the same reference characters used throughout the drawings refer to the same or like parts. While embodiments of the invention are directed to a nozzle tip for a solid fuel-fired furnace, embodiments of the invention may also be used to control the velocity of fuel in any state (i.e., solid, liquid or gas).

Referring now to the drawing, and more particularly to FIG. 1 thereof, there is depicted therein a pulverized solid fuel-fired furnace, generally designated by reference numeral 10. Inasmuch as the nature of the construction and the mode of operation of pulverized solid fuel-fired furnaces known to those skilled in the art, it is not deemed necessary, therefore, to set forth herein a detailed description of the pulverized solid fuel-fired furnace 10 illustrated in FIG. 1. Rather, for purposes of obtaining an understanding of a pulverized solid fuel-fired furnace 10 in the firing system of which a solid fuel nozzle tip constructed in accordance with the invention is suited for employment, it is deemed to be sufficient that there be presented herein merely a description of the nature of the components of the pulverized solid fuel-fired furnace 10 and of the components of the firing system with which the pulverized solid fuel-fired furnace 10 is suitably provided and with which the solid fuel nozzle tip cooperates.

Referring further to FIG. 1, the pulverized solid fuel-fired furnace 10 includes a burner region 14. It is within the burner region 14 of the pulverized solid fuel-fired furnace 10 that, in a manner known to those skilled in this art, combustion of the pulverized solid fuel and air is initiated. The hot gases that are produced from combustion of the pulverized solid fuel and air rise upwardly in the pulverized solid fuel-fired furnace 10. During the upwardly movement thereof in the pulverized solid fuel-fired furnace 10, the hot gases give up heat to the fluid passing through the tubes (not shown) that in conventional fashion line all four of the walls of the pulverized solid fuel-fired furnace 10. Then, the hot gases exit the pulverized solid fuel-fired furnace 10 through the horizontal pass 16, which in turn leads to the rear gas pass 18. Both the horizontal pass 16 and the rear gas pass 18 commonly contain other heat exchanger surface (not shown) for generating and superheating steam, in a manner known to those skilled in the art. Thereafter, the steam commonly is made to flow to a turbine (not shown), which forms one component of a turbine/generator set (not shown), such that the steam provides the motive power to drive the turbine (not shown) and thereby also the generator (not shown), which in known fashion is cooperatively associated with the turbine, such that electricity is thus produced from the generator (not shown).

With the preceding by way of background, reference is once again had to FIG. 1 for purposes of setting forth herein a description of the nature of the construction and the mode of operation of the firing system with which the pulverized solid fuel-fired furnace 10 is suitably provided. The subject firing system as seen with reference to FIG. 1 includes a housing in the form of a main windbox 20 that is provided with a plurality of air compartments (not shown) through which air supplied from a suitable source thereof (not shown) is injected into the burner region 14 of the pulverized solid fuel-fired furnace 10. In addition, the windbox 20 is provided with a plurality of fuel compartments (not shown) through which solid fuel is injected into the burner region 14. The solid fuel, which is injected through the aforereferenced plurality of fuel compartments (not shown), is supplied to this plurality of fuel compartments (not shown) by means of a pulverized solid fuel supply means, denoted generally by the reference numeral 22 in FIG. 1. To this end, the pulverized solid fuel supply means 22 includes a pulverizer, denoted generally by the reference numeral 24 in FIG. 1, and a plurality of pulverized solid fuel ducts 26. The pulverized solid fuel is transported through the pulverized solid fuel ducts 26 from the pulverizer 24 to which the pulverized solid fuel ducts 26 are connected in fluid flow relation to the previously mentioned plurality of fuel compartments (not shown) to which the pulverized solid fuel ducts 26 are also connected in fluid flow relation. Although not shown in the interest of maintaining clarity of illustration in the drawing, the pulverizer 24 is operatively connected to a fan (not shown), which in turn is operatively connected in fluid flow relation with the previously mentioned plurality of air compartments (not shown), such that air is supplied from the fan (not shown) to not only the aforesaid plurality of air compartments (not shown) but also to the pulverizer 24 whereby the pulverized solid fuel supplied from the pulverizer 24 to the aforesaid plurality of fuel compartments (not shown) is transported through the pulverized solid fuel ducts 26 in an air stream in a manner known in the art.

In further regard to the nature of the firing system, two or more discrete levels of separated overfire air are incorporated in each corner of the pulverized solid fuel-fired furnace 10 so as to be located between the top of the main windbox 20 and the furnace outlet plane 28. To this end, the firing system with which the pulverized solid fuel-fired furnace 10 is suitably provided embodies two or more discrete levels of separated overfire air, i.e., a low level of separated overfire air denoted generally in FIG. 1 of the drawing by the reference numeral 30 and a high level of separated overfire air denoted generally in FIG. 1 of the drawing by the reference numeral 32. The low level 30 of separated overfire air is suitably supported through the use of any conventional form of support means (not shown) suitable for use for such a purpose within the burner region 14 of the pulverized solid fuel-fired furnace 10 so as to be suitably spaced from the top of the windbox 20, and so as to be substantially aligned with the longitudinal axis of the main windbox 20. Similarly, the high level 32 of separated overfire air is suitably supported through the use of any conventional form of support means (not shown) suitable for use for such a purpose within the burner region 14 of the pulverized solid fuel-fired furnace 10 so as to be suitably spaced from the low level 30 of separated overfire air, and so as to be substantially aligned with the longitudinal axis of the main windbox 20. The low level 30 of separated overfire air and the high level 32 of separated overfire air are suitably located between the top of the main windbox 20 and the furnace outlet plane 28 such that it will take the gases generated from the combustion of the pulverized solid fuel a preestablished amount of time to travel from the top of the main windbox 20 to the top of the high level 32 of separated overfire air.

While not illustrated in FIG. 1, pulverized solid fuel nozzles each having a solid fuel nozzle tip are suitably supported in mounted relation within each of the plurality of fuel compartments (not shown) to which reference has been had hereinbefore. The nozzles, and nozzle tips thereof, are mounted so as to direct pulverized solid fuel (e.g., a solid fuel such as coal and biomass, or coal) and air into the burner region 14 of the furnace. As indicated below, according to embodiments of the invention, the nozzle tip of one or more of the nozzles is configured so as to allow for vertical and/or horizontal angular adjustment of the nozzle tip, as well adjustment of the cross-sectional area of the nozzle tip outlet.

Referring now to FIGS. 2-6, a nozzle tip 100 of a solid fuel nozzle for use in a solid fuel burner/furnace (e.g., furnace 10) according to one embodiment of the invention, is shown. It is contemplated that the nozzle tips of the invention disclosed herein may be utilized in any windbox configuration, without or without separate overfire air ports. As shown therein, the nozzle tip 100 includes an inner nozzle portion 110 and an outer nozzle portion 112 within which the inner nozzle portion 110 is mounted. In an embodiment, the inner nozzle portion 110 is a unitary, cast piece formed from, for example, ceramic. The inner portion may be formed from cast ceramics which may be comprised of ceramics including silicon nitride, siliconized silicon carbide, mullite bonded silicon carbide alumina composite, alumina zirconia composites and alumina composite with optimized fiber. As illustrated, the inner nozzle portion 110 is generally rectangular in shape and is tapered such that a cross-sectional area of the rear end of the inner nozzle portion 110 is greater than the cross-sectional area of the forward or outlet end of the inner nozzle portion 110. In an embodiment, as shown in FIGS. 2-6, the inner nozzle portion 110 may have a partition 120 that separates the interior space into two passages 114, 116 stacked atop one another.

Figure 2:
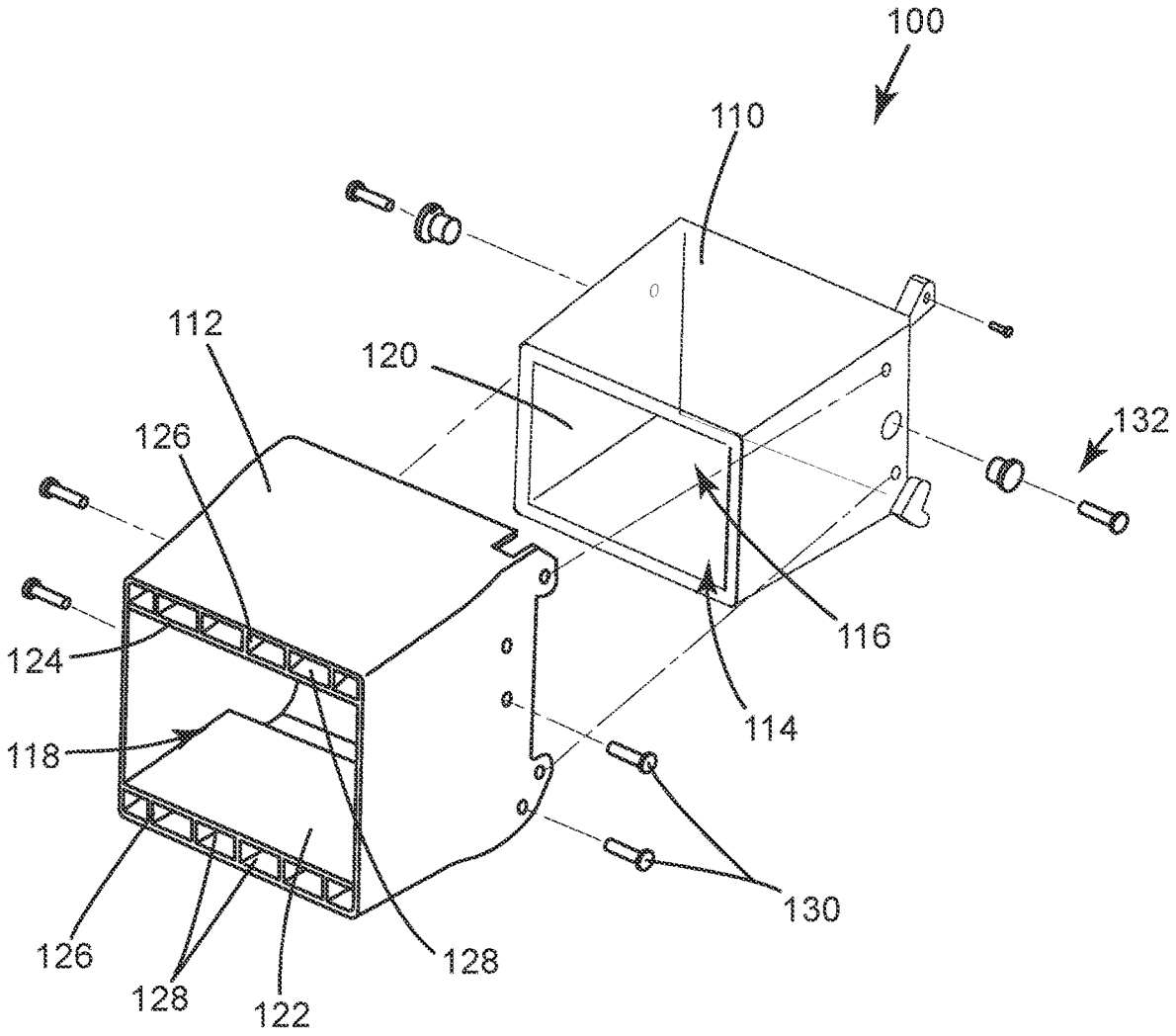
FIG. 2 is an exploded, perspective view of a solid fuel nozzle tip for use with the pulverized solid fuel-fired furnace of FIG. 1, according to an embodiment of the invention.
Figure 3:
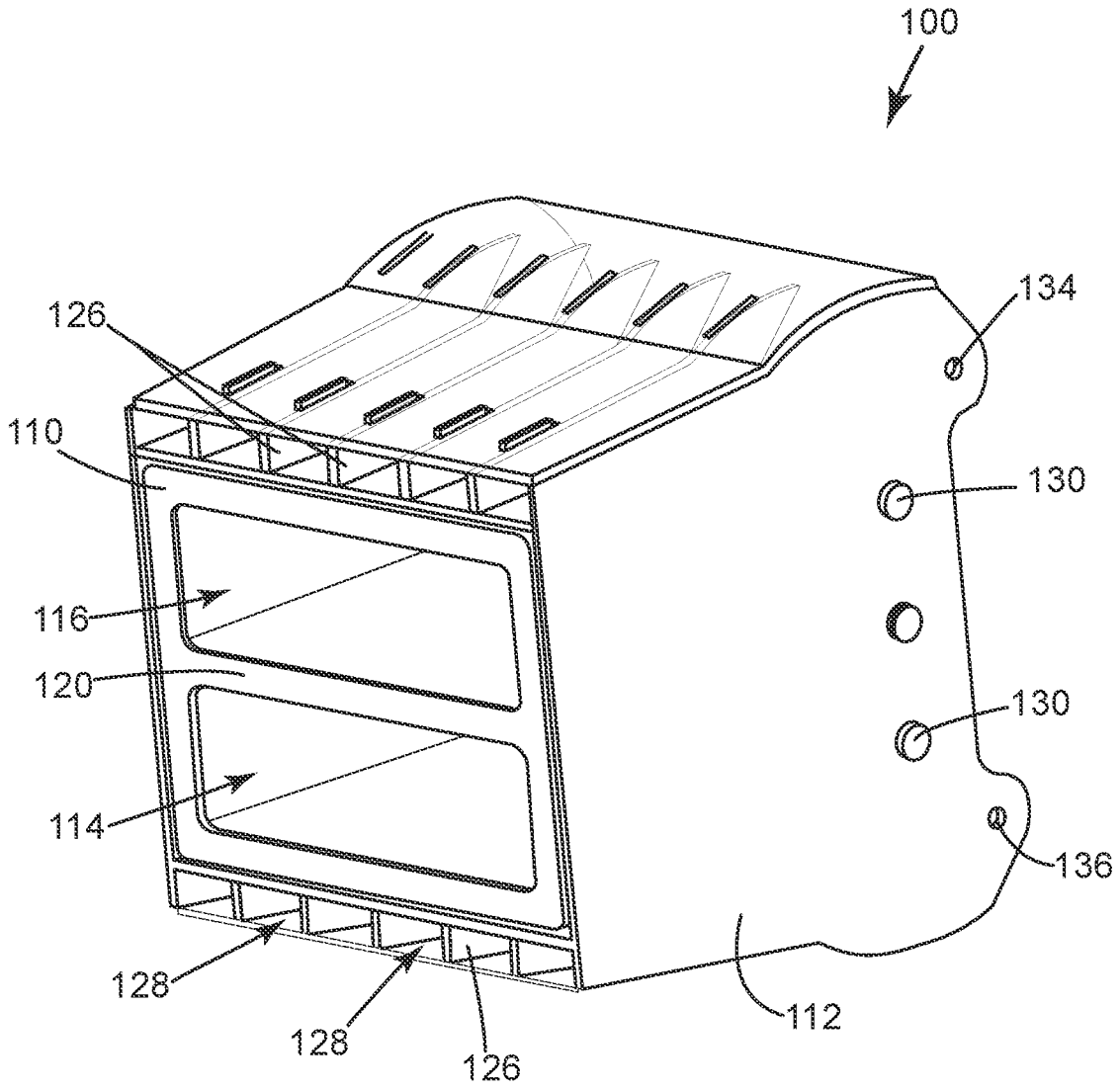
FIG. 3 is a front perspective view of the nozzle tip of FIG. 2.
Figure 4:
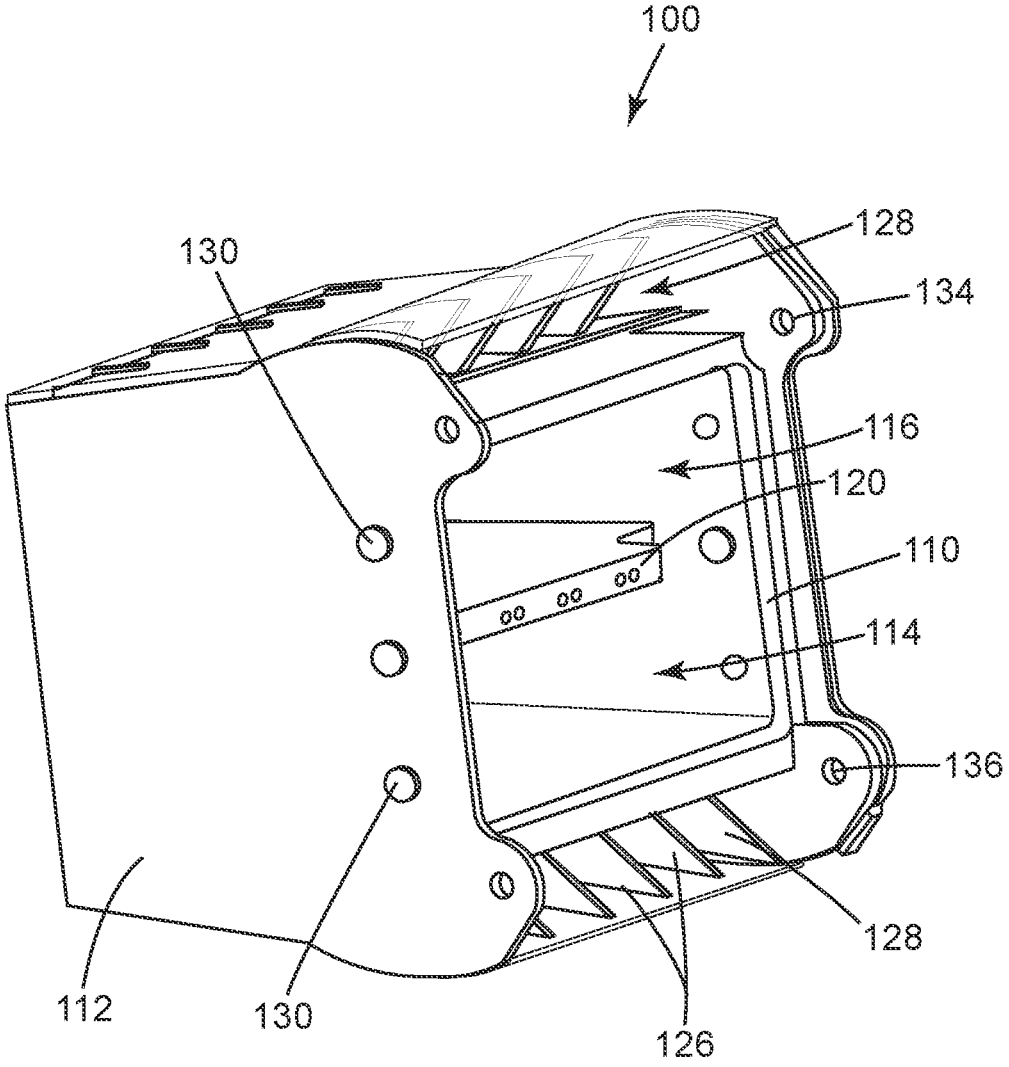
FIG. 4 is a rear perspective view of the nozzle tip of FIG. 2.
Figure 5:
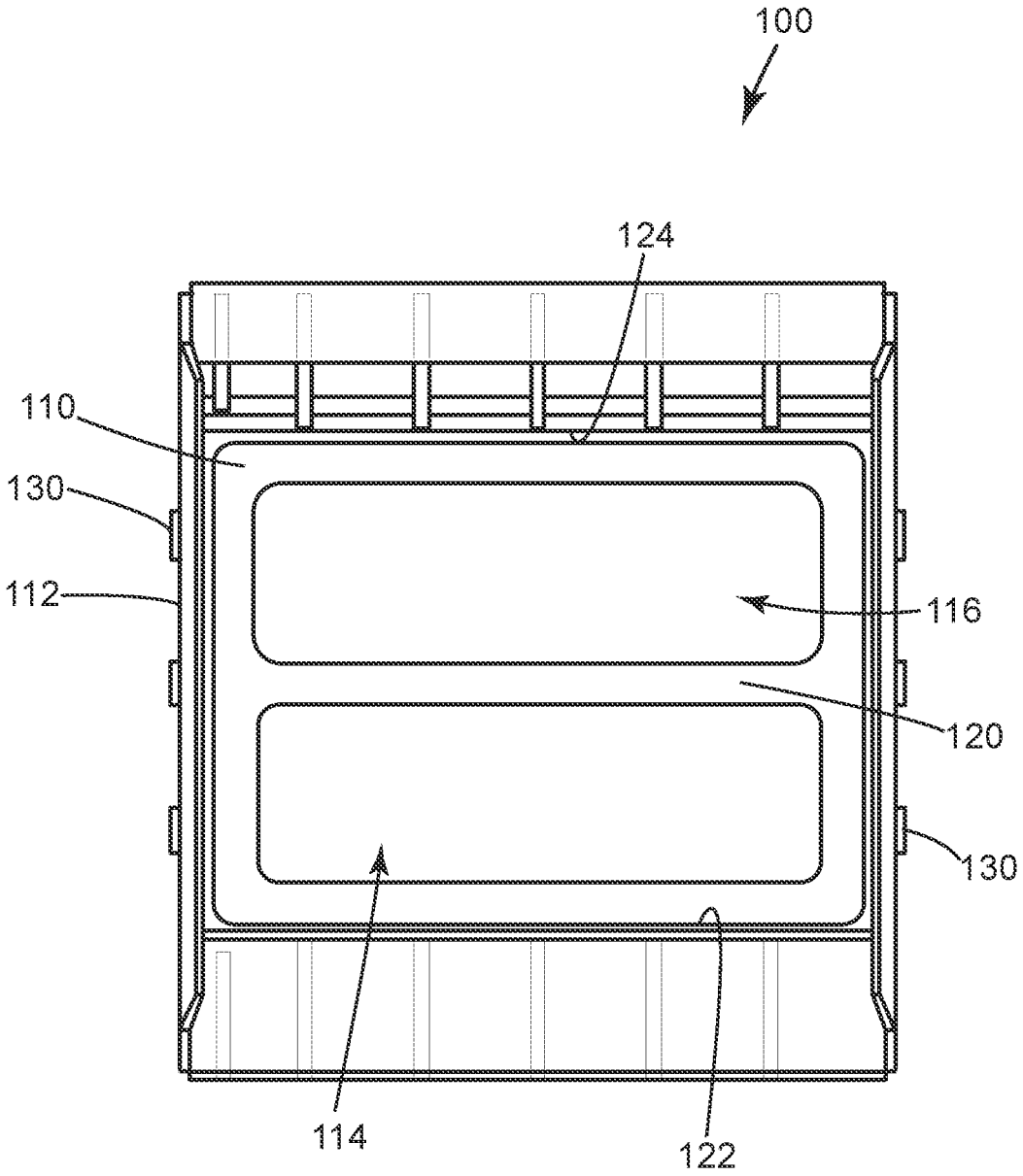
FIG. 5 is a front elevational view of the nozzle tip of FIG. 2.
Figure 6:
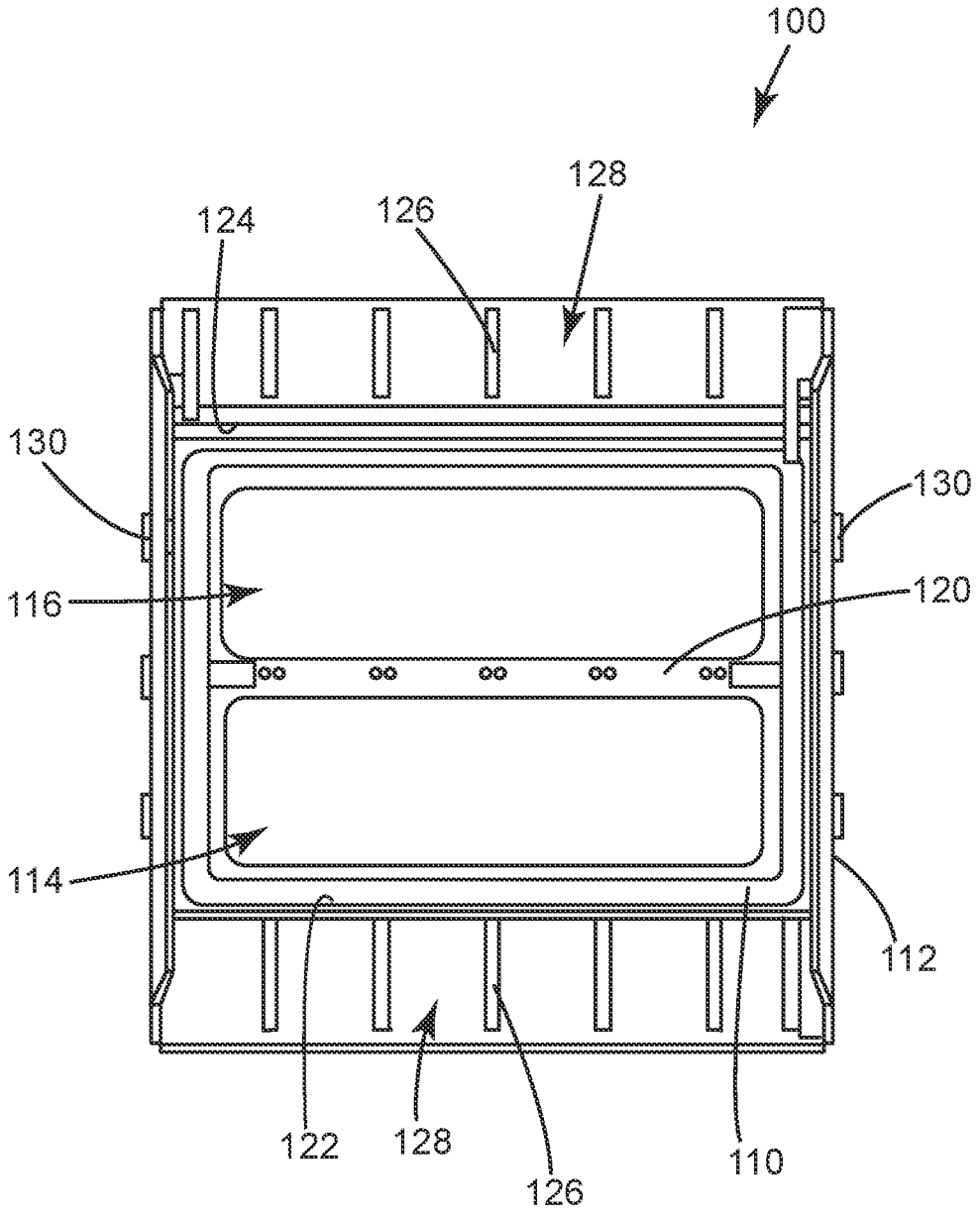
FIG. 6 is a rear elevational view of the nozzle tip of FIG. 2.

As perhaps best shown in FIG. 2, the outer nozzle portion 112 is generally rectangular in shape, and has an open interior space 118 that generally corresponds in size and shape to the outer surface/shape of the inner nozzle portion 110. For example, where the inner nozzle portion 110 is tapered in shape, the interior space 118 may likewise be tapered in shape. As also shown in FIG. 2, the outer nozzle portion 112 includes upper and lower supporting surfaces 122, 124, respectively, and a plurality of vertically-oriented ribs 126 extending between the outer housing of the outer nozzle portion 112 and the upper and lower supporting surfaces 122, 124, respectively. These ribs 126 define therebetween a plurality of flow passages 128 that extend from the rear end to the forward end of the outer nozzle portion 112. In an embodiment, the supporting surfaces 122, 124 are substantially planar.

As indicated above, the inner nozzle portion 110 is receivable within the outer nozzle portion 112 such that the upper and lower outer surfaces of the inner nozzle portion 110 are closely received by, and supported on, the upper and lower supporting surfaces 122, 124 of the outer nozzle portion 112. In this respect, the outer nozzle portion 112 functions as a shroud that protects and supports the inner nozzle portion 110. In an embodiment, the outer nozzle portion 112 is formed form a material that is capable of withstanding the harsh environment (e.g., high operating temperatures and impacts from falling slag) within the combustion chamber within which the nozzle tip 100 is positioned. For example, in an embodiment, the outer nozzle portion may be formed from stainless steel.

As illustrated in FIGS. 2-6, the inner and outer nozzle portions 110, 112 are fixedly connected to one another via mounting pins 130. This connection mechanism allows for some degree of differential thermal expansion between the inner nozzle portion 110 and outer nozzle portion 112. Opposed center pins 132 of the nozzle tip 100 allow for mounting of the nozzle tip to a coal nozzle (not shown). Upper and lower pins are utilized to connect the nozzle tip 100 to tilt arms of a nozzle assembly via mounting apertures 134, 136, and allow for tilting or angling of the nozzle tip 100 during operation, as is known in the art.

As indicated above, the upper and lower support surfaces 122, 124 of the outer nozzle portion 112 provide large surface areas for supporting the upper and lower surfaces of the inner nozzle portion 110. This is in contrast to existing devices where support for the cast ceramic nozzle tip is only provided at discrete points. Indeed, the flat surface contact between cast ceramic monolith 110 and stainless steel casing 112 is in contrast to point contact, which has heretofore been a feature of the prior art. These support surfaces 122, 124 are bolstered by the strengthening ribs 126 which, in addition to providing bolstering support for the inner nozzle portion 110 when it is received within the interior space 118, also define therebetween flow passages for the passage of air (e.g., secondary air that surrounds the flow of pulverized coal).

The stainless steel outer nozzle portion 112, as disclosed above, is much stronger than ceramic, and thereto prevents damage from falling slag. Additionally, air cooling through the outer nozzle portion 112 (i.e., through passages 128) minimizes potential warpage. This particular combination therefore provides a level of durability and useful service life/longevity heretofore not seen in the art.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A nozzle tip for a pulverized solid fuel pipe nozzle of a pulverized solid fuel-fired furnace, comprising:

an inner nozzle portion, the inner nozzle portion having a housing with an upper outer surface and a lower outer surface; and an outer nozzle portion, the outer nozzle portion having a housing, a lower supporting surface and an upper supporting surface within the housing of the outer nozzle portion, and a plurality of ribs extending between the housing of the outer nozzle portion and the lower supporting surface and a plurality of ribs extending between the housing of the outer nozzle portion and the upper supporting surface;

wherein the inner nozzle portion is receivable within the outer nozzle portion, wherein the lower supporting surface and the upper supporting surface of the outer nozzle portion are configured to support the housing of the inner nozzle portion when the inner nozzle portion is received within the outer nozzle portion;

wherein the upper outer surface and the lower outer surface of the housing of the inner nozzle portion are supported on the lower supporting surface and the upper supporting surface of the outer nozzle portion, wherein the upper supporting surface and the lower supporting surface of the outer nozzle portion provide large surface areas for supporting the upper outer surface and the lower outer surface of the housing of the inner nozzle portion, wherein there is flat surface contact between the upper outer surface and the lower outer surface of the housing of the inner nozzle portion and the corresponding upper supporting surface and lower supporting surface of the outer nozzle portion.

2. The nozzle tip of claim 1, wherein:

the plurality of ribs define therebetween a plurality of flow passages for the passage of air; and wherein the plurality of ribs provide bolstering support for the lower supporting surface of the outer nozzle portion.

3. The nozzle tip of claim 1, wherein:

the inner nozzle portion is ceramic; and the outer nozzle portion is stainless steel.

4. The nozzle tip of claim 1, wherein:

the inner nozzle portion is fixedly connected to the outer nozzle portion.

5. The nozzle tip of claim 1, wherein:

the outer nozzle portion has a tapered shape moving in a direction from a rear end to a forward end.

6. The nozzle tip of claim 1, wherein:

the lower supporting surface of the outer nozzle portion is planar and is configured to contact the corresponding lower outer surface of the housing of the inner nozzle portion; and the upper supporting surface of the outer nozzle portion is planar and is configured to contact the corresponding upper outer surface of the housing of the inner nozzle portion.

7. The nozzle tip of claim 1, wherein:

the outer nozzle portion has a plurality of mounting points for pivotally coupling the nozzle tip to tilt arms of the pulverized solid fuel pipe nozzle.

* * * * *